US011850611B2

(12) United States Patent
Bodet et al.

(10) Patent No.: US 11,850,611 B2
(45) Date of Patent: Dec. 26, 2023

(54) TWO-PIECE NOZZLE FOR AEROSOL DISPENSERS

(71) Applicant: LINDAL FRANCE SAS, Val de Briey (FR)

(72) Inventors: Hervé Bodet, Verdun (FR); Bernard Borel, Moirans (FR)

(73) Assignee: LINDAL FRANCE SAS, Val de Briey (FR)

( * ) Notice: Subject to any disclaimer, the term of this patent is extended or adjusted under 35 U.S.C. 154(b) by 416 days.

(21) Appl. No.: 16/761,586

(22) PCT Filed: Oct. 19, 2018

(86) PCT No.: PCT/EP2018/078705

§ 371 (c)(1),
(2) Date: May 5, 2020

(87) PCT Pub. No.: WO2019/086272

PCT Pub. Date: May 9, 2019

(65) Prior Publication Data

US 2020/0269261 A1 Aug. 27, 2020

(30) Foreign Application Priority Data

Nov. 6, 2017 (FR) ..... 1760409

(51) Int. Cl.
*B05B 1/34* (2006.01)
*B65D 83/14* (2006.01)

(52) U.S. Cl.
CPC ..... *B05B 1/3415* (2013.01); *B05B 1/3436* (2013.01); *B65D 83/753* (2013.01)

(58) Field of Classification Search
CPC ... B05B 1/3415; B05B 1/3436; B05B 1/3426; B05B 1/3431; B65D 83/753
See application file for complete search history.

(56) References Cited

U.S. PATENT DOCUMENTS 2,674,493 A * 4/1954 Franz ..... B05B 1/3442 239/483
6,415,994 B1 7/2002 Boggs
(Continued)

FOREIGN PATENT DOCUMENTS

CN 204544496 U 8/2015
DE 29802025 U1 4/1998
(Continued)

OTHER PUBLICATIONS

International Search Report and Written Opinion dated Jan. 2, 2019 in corresponding application No. PCT/ EP2018/078705; w/ English partial translation and partial machine translation (total 23 pages).
(Continued)

*Primary Examiner* — Steven M Cernoch
(74) *Attorney, Agent, or Firm* — Seckel IP, PLLC

(57) ABSTRACT

A two-piece nozzle for an aerosol dispenser has an outer piece with a tubular wall open on one side and closed on the other by a front wall (122), forming a cavity, with an outlet opening (123) in a center of the front wall; an inner piece dimensioned to penetrate into the cavity of the outer piece and be retained there, piece; channels (112, 125) in the cavity of the outer piece and/or on the surface of the inner piece, wherein said channels open into a turbulence chamber (127) in communication with the outlet opening (123) placed downstream in the flow path of the product flow; and a protrusion (113, 114) in the center of the front face of the inner piece, whose free portion opposite the front face, called torpedo (114) penetrates into the outlet opening (123) to reduce its cross section and form an annular outlet orifice.

19 Claims, 6 Drawing Sheets

(56) References Cited

U.S. PATENT DOCUMENTS

Figure 1:
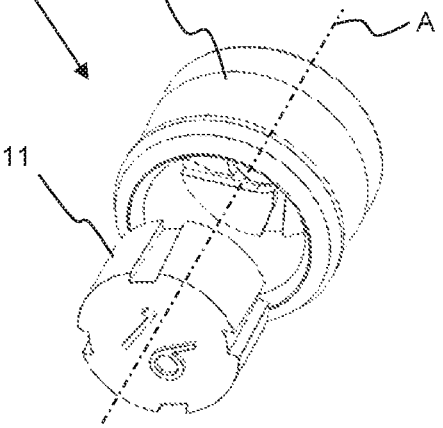

| | | | | |
|---|---|---|---|---|
| 6,722,585 | B1 | 4/2004 | Stradella | |
| 9,527,092 | B2 | 12/2016 | Miyamoto et al. | |
| 2009/0020568 | A1 | 1/2009 | Laidler et al. | |
| 2013/0087638 | A1 | 4/2013 | Miyamoto et al. | |
| 2016/0039596 | A1* | 2/2016 | Nelson | B05B 1/3436 239/590.5 |

FOREIGN PATENT DOCUMENTS

| | | | |
|---|---|---|---|
| EP | 2570110 | A2 | 3/2013 |
| EP | 2583756 | A1 | 4/2013 |
| FR | 2792552 | A1 | 10/2000 |
| SU | 1026836 | A2 | 7/1983 |
| WO | 2006095153 | A1 | 9/2006 |

OTHER PUBLICATIONS

EP Search Report and Written Opinion dated Oct. 12, 2020 in corresponding divisional application No. EP20176158; w/ English machine translation (total 13 pages).

* cited by examiner

TWO-PIECE NOZZLE FOR AEROSOL DISPENSERS

The invention concerns a two-piece nozzle for an aerosol dispenser.

Many products are applied as an aerosol. To spray a product contained in a generator of pressurized aerosol, a dispenser is placed at the outlet of the valve, the role of the dispenser being, on the one hand, to actuate the valve, and on the other hand, to direct the jet in a predefined direction. To this end, the dispenser is provided with a conduit leading from the stem of the valve to an outlet orifice. In order to obtain a spray with finely divided droplets and not a jet of liquid or drops, a nozzle is generally placed at the outlet of the conduit. This nozzle is traditionally made up of a tumbler-shaped insert provided in its bottom with a small central orifice and fitted on a tenon made in the dispenser, at the end of the conduit. The conduit of the dispenser ends in one or several longitudinal channels distributed over the circumference of the tenon. Another solution consists in placing, in a cavity made at the end of the conduit of the dispenser, a nozzle made up of two pieces, namely an inner piece performing the function of the tenon of the dispenser and an outer piece similar to the insert. The longitudinal channels are then placed either on the inner piece or on the outer piece. Such a two-piece nozzle is known, for example, from U.S. Pat. No. 9,527,092 B2. To improve the quality of the spray, convergent channels that open tangentially into a circular or annular turbulence chamber surrounding the outlet orifice are placed in the bottom of the insert or on the front face of the tenon or of the inner piece. The nozzle is then called a vortex nozzle (mechanical break-up or MBU). The determining factors for the quality of the spray are, among others, the geometry and distribution of the channels, the diameter of the outlet orifice, and the conical shape of the outlet orifice. However, the current injection techniques for the inserts do not make it possible to reliably obtain outlet orifices having diameters less than 0.2 mm.

Furthermore, mastering the fitting of the insert into the dispenser or the assembly of the two-piece nozzle is complex, and the quality of the spray depends strongly on the angular positioning of the insert on the tenon of the dispenser, or of the inner piece relative to the outer piece. To ensure that the longitudinal channels coincide with the converging channels when they are not made on the same piece, it is common to design the longitudinal channels with much larger angular sectors than those of the converging channels. Even if the insert or the outer piece is not exactly oriented with respect to the tenon or the inner piece, the converging channels are necessarily in the continuity of the longitudinal channels.

The objective of the invention is therefore to improve the two-piece nozzles of the state of the art.

This objective is achieved by a nozzle for an aerosol dispenser, in particular for a dispenser of pressurized aerosol, comprising

- an outer piece provided with a tubular wall open on one side and closed on the other by a front wall, forming a cavity, the front wall being provided in its center with an outlet opening, the outer piece having a certain symmetry about an axis of symmetry,
- an inner piece separate from the dispenser for which the nozzle is intended, said inner piece being dimensioned to penetrate into the cavity of the outer piece while being retained there, the inner piece having a front face facing the front wall of the outer piece,

- channels being made in the cavity of the outer piece and/or on the surface of the inner piece, which channels open into a central turbulence chamber in communication with the outlet opening, the outlet opening being placed in the flow path of the product flow downstream of the turbulence chamber.

According to the invention, a protrusion is placed in the center of the front face of the inner piece, this protrusion being dimensioned so that its free portion opposite the front face, which portion is called torpedo, penetrates into the outlet opening to decrease its transverse cross-section and form an annular outlet opening. Thus, it is possible to manufacture outer pieces with outlet openings that are too large to ensure good spraying, the torpedo being used to reduce significantly the transverse cross-section of the outlet opening. By adapting the diameter of the torpedo to the diameter of the outlet opening, it is possible to obtain transverse cross-sections smaller than those that could be obtained using current methods for the mass production of these nozzles. In addition, the diameter of the opening and/or of the torpedo can be adapted to the properties of the product to be dispensed.

Preferably, the torpedo is dimensioned to pass through the outlet opening over its entire height, so that, in the assembled state of the nozzle, the front face of the torpedo is flush with the outer face of the front wall of the cavity of the outer piece. The transverse cross-section of the annular outlet orifice can be less than 0.0315 $mm^2$.

In a preferred embodiment of the invention, the portion of the outlet opening located near the outer face of the front wall has a frustoconical shape, and the end of the torpedo located opposite the front face has a cylindrical shape, so that the transverse cross-section of the annular space between the outlet opening and the torpedo decreases as it approaches the outer face of the front wall.

The cavity of the outer piece and the inner piece have preferably the shape of a cylinder of revolution or of a cone of revolution about the axis of symmetry. It is self-evident that it would also be possible to provide other shapes, in particular a cylinder or a cone with a polygonal base. Similarly, it would be possible for the front face of the inner piece and/or for the front wall of the outer piece to have a domed shape, for example, a hemispherical shape.

The channels can be divided into lateral channels made in the cylindrical or frustoconical envelope of the inner piece and/or of the cavity of the outer piece, and into converging channels made in the front wall of the outer piece or in the front face of the inner piece.

Depending on needs, the lateral channels can be substantially parallel to an axial plane defined by the axis of symmetry defining the cylindrical or frustoconical shapes of the inner piece and the outer piece, or on the contrary, they can diverge from an axial plane defined by the axis of symmetry. In particular, the lateral channels can have a helical shape. This latter shape is particularly simple to produce on the inner piece. When the lateral channels are substantially parallel to an axial plane defined by the axis of symmetry, their length is the shortest. Conversely, if they deviate from this direction, they are longer. The modification of the length of the lateral channels makes it possible to adapt the flow rate of the flow of material. It is also possible, by tilting the lateral channels, at least at their junction with the converging channels, to orient the flow in a predetermined and optimized manner as it enters the converging channels, which contributes to perfecting the quality of the spray. Thus, it is possible to avoid angles, or at least angles which are too great, at the junction between the lateral channels and the converging channels, which converging channels are generally inclined relative to the radiant plane.

The converging channels can extend from the cylindrical or frustoconical envelope of the inner piece or of the cavity of the outer piece toward the turbulence chamber, into which they open preferably tangentially.

It can be advantageous for the nozzle to be immobilized in the cavity, in particular to guarantee that the lateral channels align exactly with the converging channels. In this case, the nozzle can be provided with fixing means for fixing the inner piece in the cavity of the outer piece so that it is immobilized in the cavity. Another solution consists in dimensioning the inner piece so that it is retained by a tight fit in the cavity of the outer piece so as to be immobilized there. To facilitate assembly of the inner piece in the outer piece, the inner piece and/or the outer piece can be provided with first orientation means for orienting the inner piece relative to the outer piece in order to align the channels with one another. Another solution consists in orienting the inner piece before transferring it into the cavity of the outer piece.

Conversely, in other cases, it can be advantageous to provide the inner piece mobile in rotation in the outer piece. In this case, the nozzle can be provided with retaining means for retaining the inner piece in the cavity of the outer piece so that it is mobile in rotation in the cavity about the axis of symmetry.

When the nozzle is to be used with two-way valves, it can be provided that the conduit of the dispenser extends the separation of the two paths until its outlet end, and that a portion of the channels of the nozzle is intended for one of the paths and the rest of the channels for the other path. In this case, it is preferable to provide the nozzle with second orientation means for orienting the nozzle relative to the dispenser for which it is intended. Another solution consists in separating sufficiently the channels from one another, or in giving them a sufficiently small angular deployment, so that a same conduit cannot be simultaneously in contact with the two paths.

It is possible to provide a rear wall of the inner piece with divergent channels, which preferably open into the lateral channels.

The nozzle of the invention can be sold alone, or it can be mounted in a housing of an aerosol dispenser, wherein the housing can have a bottom face provided with divergent channels.

Figure 2:
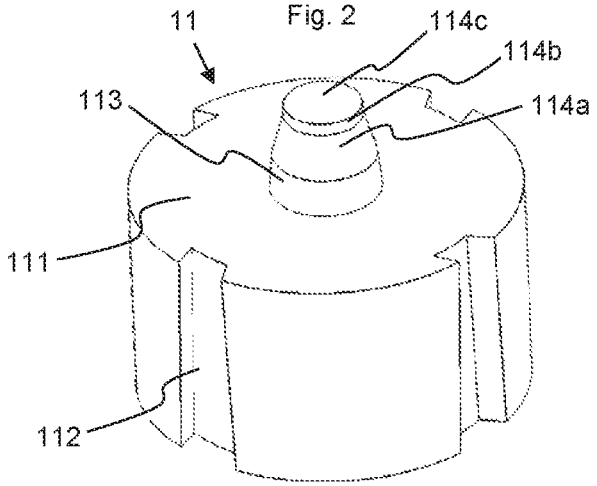
Figure 3:
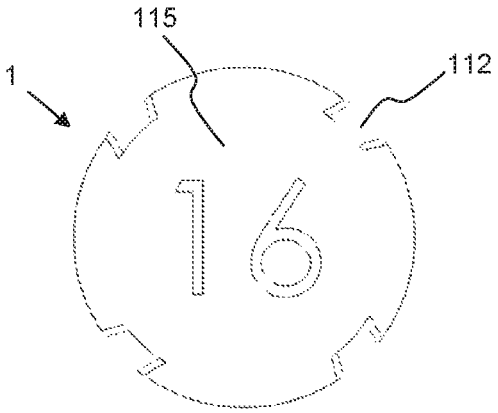
Figure 4:
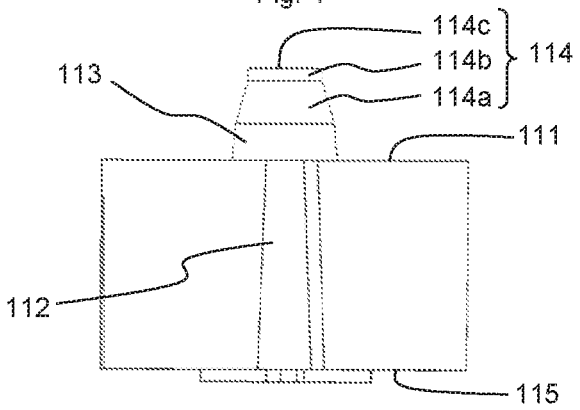
Figure 5:
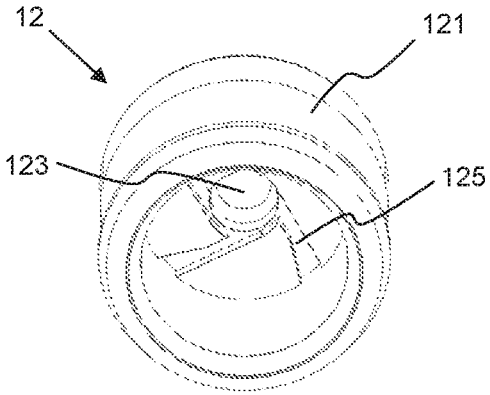
Figure 6:
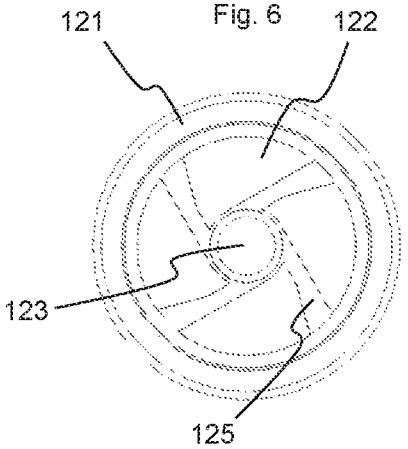
Figure 7:
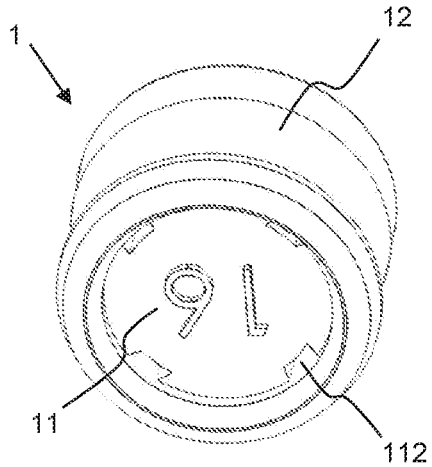
Figure 8:
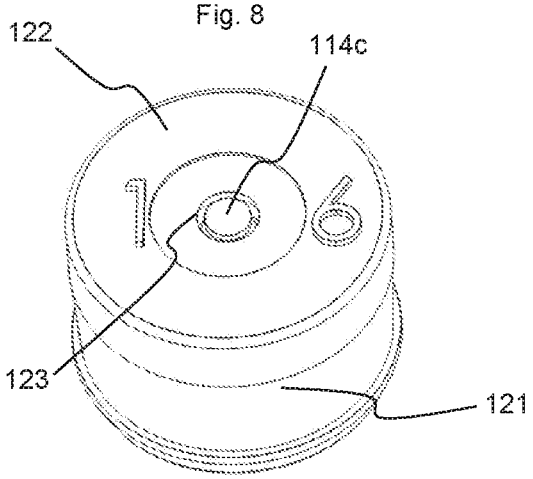
Figure 9:
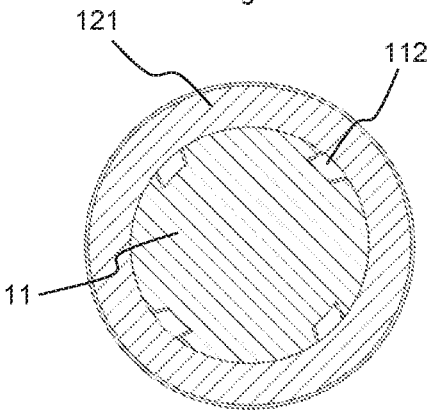
Figure 10:
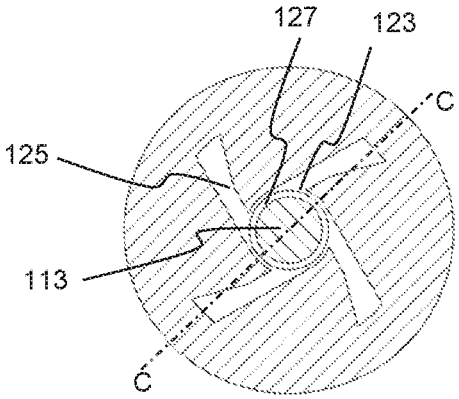
Figure 11:
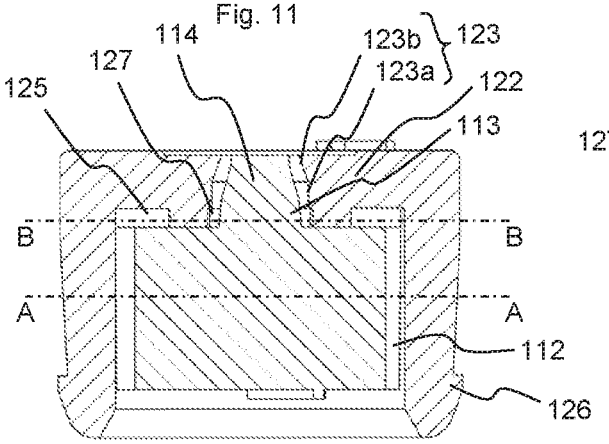
Figure 12:
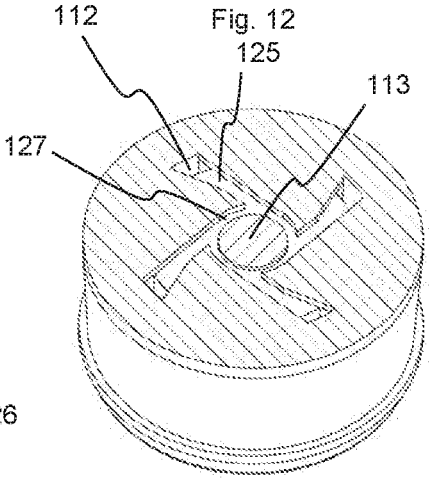
Figure 13:
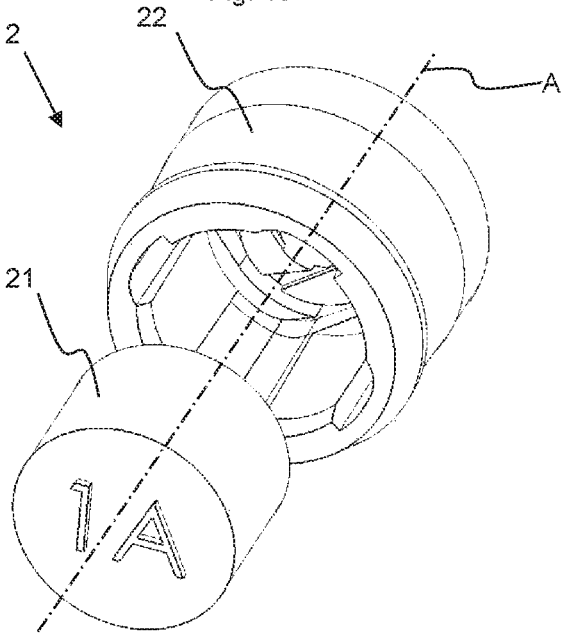
Figure 14:
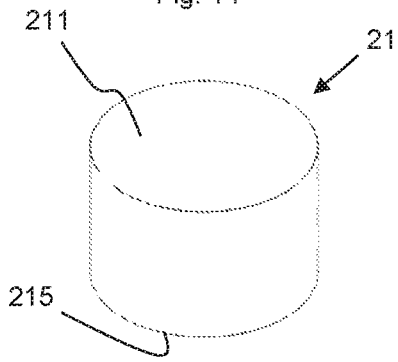
Figure 15:
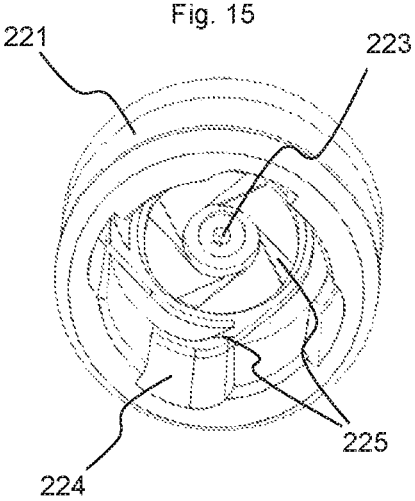
Figure 17:
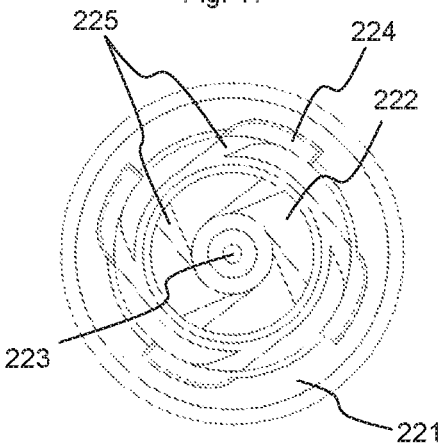
Figure 16:
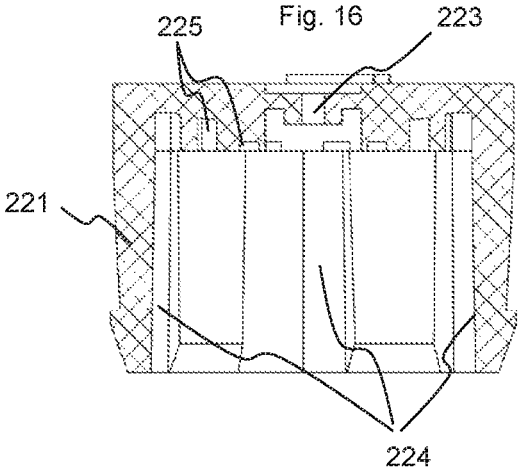
Figure 18:
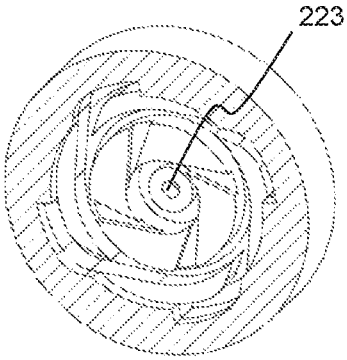
Figure 19:
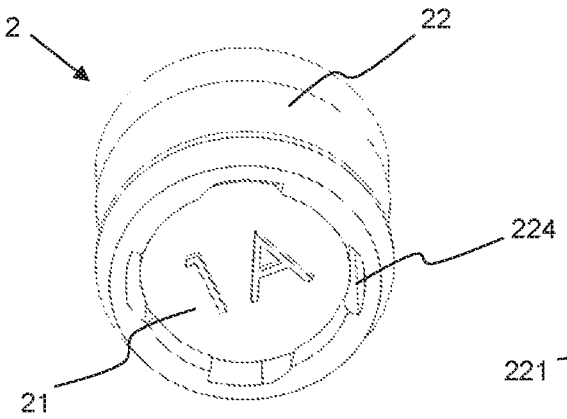
Figure 20:
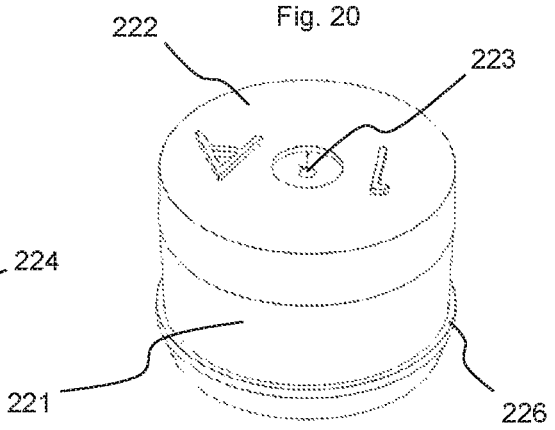
Figure 21:
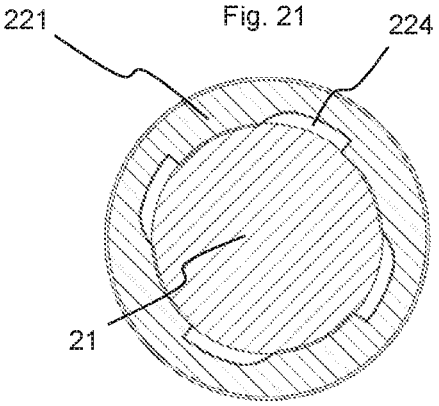
Figure 22:
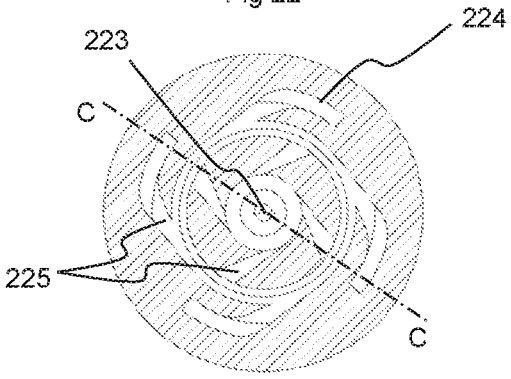
Figure 23:
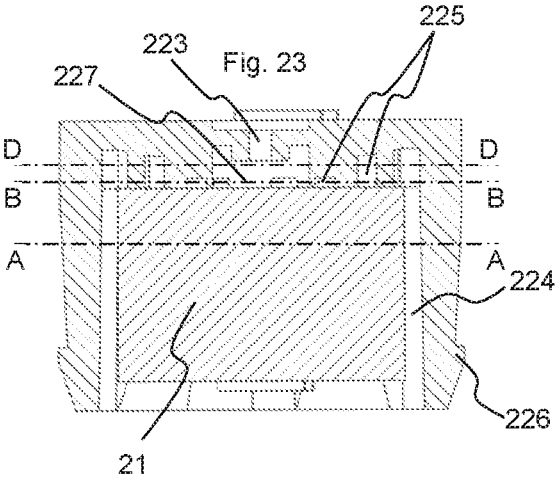
Figure 24:
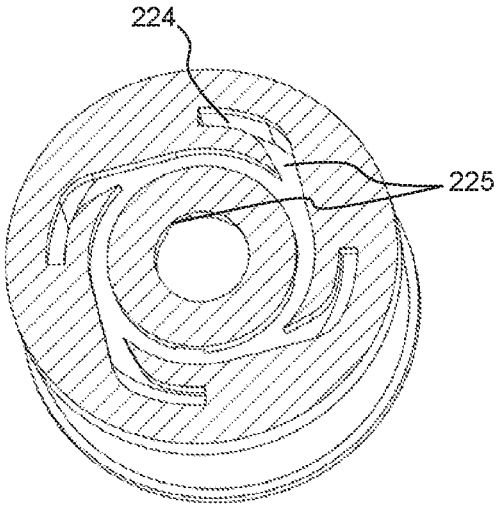
Figure 25:
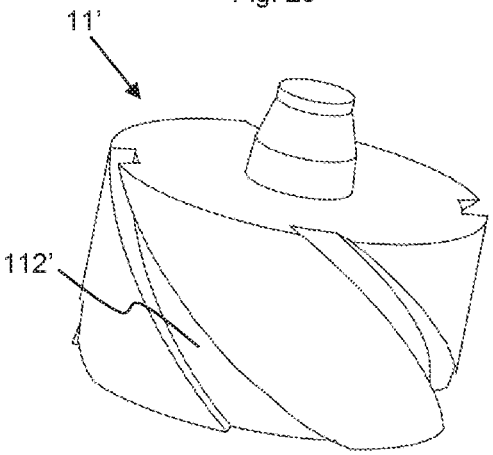
Figure 26:
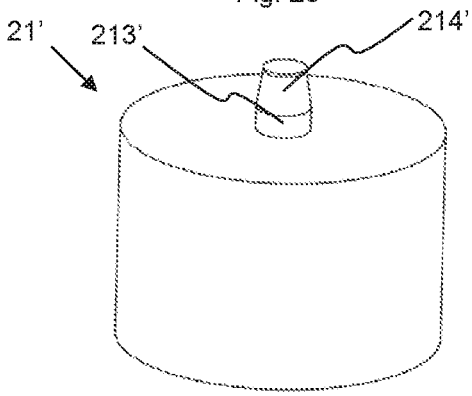
Figure 27:
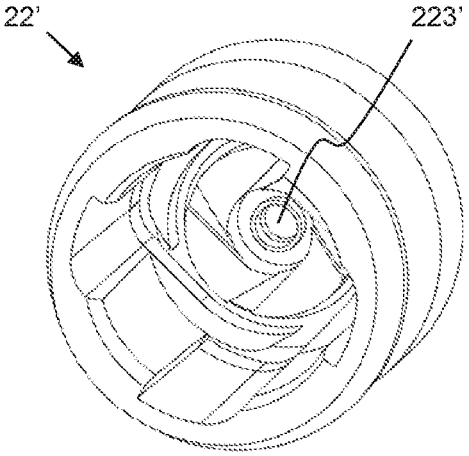
Figure 28:
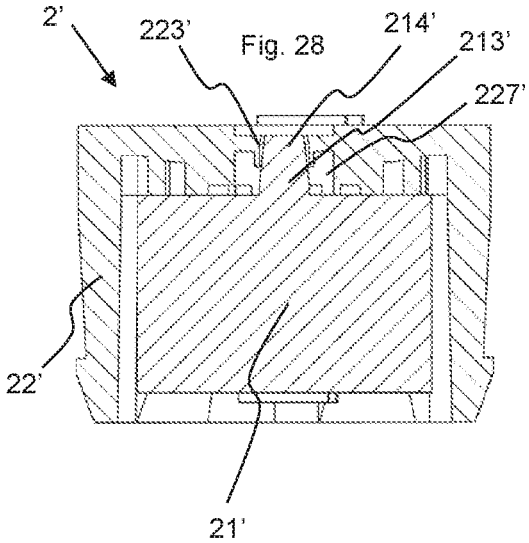
Figure 29:
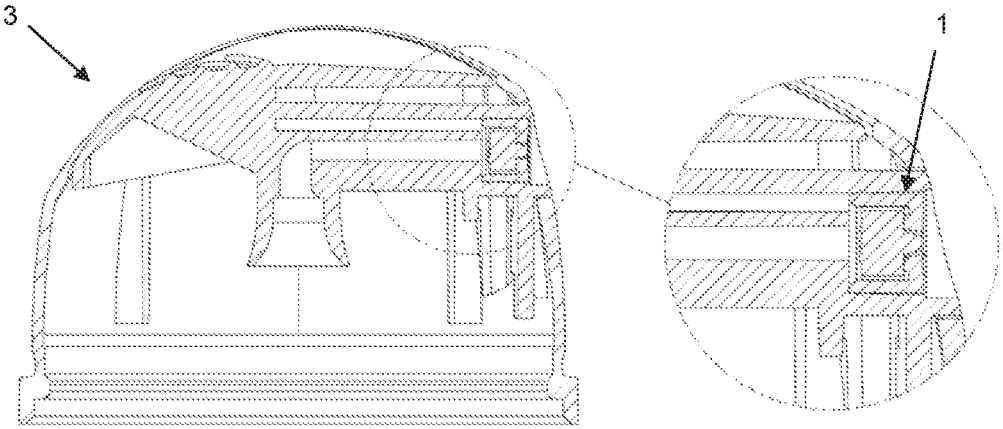

The invention is described in more detail below with the aid of two embodiments presented in the following figures, which show:

FIG. 1 an exploded view of a first nozzle according to the invention;

FIG. 2 a perspective view of the inner piece of the 1st nozzle;

FIG. 3 a bottom view of the inner piece of FIG. 2;

FIG. 4 a side view of the inner piece of FIG. 2;

FIG. 5 a perspective view from below of the outer piece of the 1st nozzle;

FIG. 6 a bottom view of the outer piece of FIG. 5;

FIG. 7 a perspective view from below of the 1st nozzle;

FIG. 8 a perspective view from above of the 1st nozzle;

FIG. 9 a horizontal cross-section of the 1st nozzle along the plane AA of FIG. 11;

FIG. 10 a horizontal cross-section of the 1st nozzle along the plane BB of FIG. 11;

FIG. 11 a vertical cross-section of the 1st nozzle along the axial plane CC of FIG. 10;

FIG. 12 a horizontal cross-section in perspective of the 1st nozzle along the plane BB of FIG. 11;

FIG. 13 an exploded view of a second nozzle according to the invention;

FIG. 14 a perspective view of the inner piece of the 2nd nozzle;

FIG. 15 a perspective view from below of the outer piece of the 2nd nozzle;

FIG. 16 a vertical cross-section of the outer piece of the 2nd nozzle;

FIG. 17 a bottom view of the outer piece of the 2nd nozzle;

FIG. 18 a horizontal cross-section in perspective of the outer piece along the plane AA of FIG. 23;

FIG. 19 a perspective view from below of the 2nd nozzle;

FIG. 20 a perspective view from above of the 2nd nozzle;

FIG. 21 a horizontal cross-section of the 2nd nozzle along the plane AA of FIG. 23;

FIG. 22 a horizontal cross-section of the 2nd nozzle along the plane BB of FIG. 23;

FIG. 23 a vertical cross-section of the 2nd nozzle along the plane CC of FIG. 22;

FIG. 24 a cross-section in perspective of the 2nd nozzle along the plane DD of FIG. 23;

FIG. 25 a perspective view of a variant of the inner piece for the first nozzle;

FIG. 26 a perspective view of an inner piece for a variant of the second nozzle;

FIG. 27 a perspective view of an outer piece for the variant of the second nozzle;

FIG. 28 a cross-section view of the variant of the second nozzle;

FIG. 29 a cross-section of a dispenser provided with the 1st nozzle.

Figure 30:
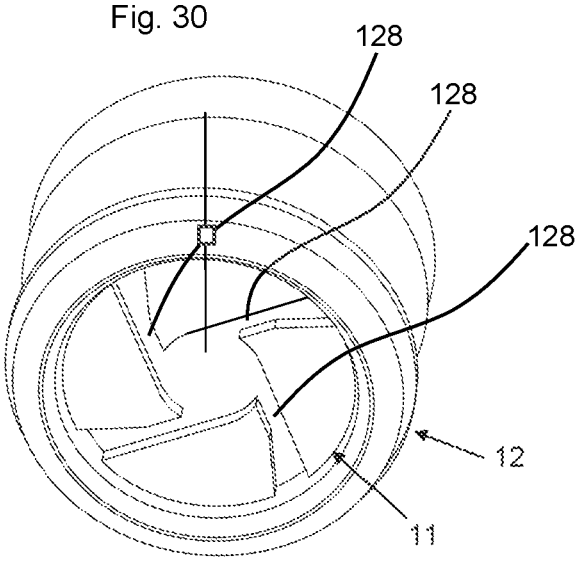
Figure 31:
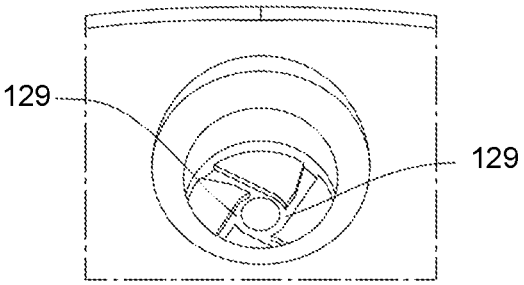

FIG. 30 a schematic view in perspective from below of FIG. 7 except in a variant where the inner piece has a rear face provided with divergent channels;

FIG. 31 a schematic partial view in perspective of the nozzle housing in the aerosol dispenser of FIG. 29 except in a variant where the housing has a bottom face provided with divergent channels.

The invention concerns a nozzle (1, 2) for an aerosol dispenser (3) intended to be placed on a valve of a pressurized container. The nozzle can also be used with an aerosol dispenser cooperating with a container which is not pressurized. The nozzle is constituted by an inner piece (11, 21) and an outer piece (12, 22). Two examples of nozzles, each having a variant, are shown in the figures. The constituent elements of variants are indicated by a sign "'".

The nozzle and its components have a certain rotational symmetry about a main axis (A) passing through the nozzle parallel to the general direction of diffusion of the product. It will be seen that this rotational symmetry is not absolute, and some parts of the nozzle deviate from it. The adjectives "axial" or "radial" refer to this main axis and define an element parallel to the axis or perpendicular to this axis, respectively. To simplify the description, the spatial references such as "upper" and "lower", "above" or "below" refer to the nozzle and its components as shown on in FIG. 11 or FIG. 23, for example. It is not an absolute position, but only a reference position for the description, and the nozzle integrated in a dispenser can be used in any position suitable for the product to be delivered.

The outer piece (12, 22) has the general shape of a tumbler formed by a tubular (121, 221) open on one side and closed on the other by a front wall (122, 222). The cavity defined by the tubular wall and the front wall has a general shape of a cylinder of revolution or of a cone of revolution. An outlet opening (123, 223) is made in the center of the front wall to bring the cavity in contact with the outer face of the front wall.

The inner piece (11, 21) has the general shape of a cylinder of revolution or of a cone of revolution substantially complementary to that of the cavity of the outer piece. It has a front face (111, 211) which, in the assembled state of the nozzle, faces the front wall (122, 222) of the outer piece, generally while being in partial contact with it.

Channels are made in the inner piece and/or in the outer piece to bring the product to be dispensed coming from the valve to the outlet opening (123, 223) of the nozzle. These channels are divided into two portions: lateral channels (112, 224) leading from the inlet of the nozzle to the front wall and converging channels (125, 225) leading from the end of the lateral channels (112, 224) to a turbulence chamber (127, 227) from which the outlet opening (123, 223) starts. The lateral channels can be made on the cylindrical or frustoconical wall of the inner piece (11), as in the first nozzle, or on the inner face of the tubular wall (221) of the outer piece, as in the second nozzle. In the examples presented here, the converging channels (125, 225) are made in the bottom of the tumbler, on the inner face of the front wall (122, 222) of the outer piece. However, it would be possible to make them on the front face (111, 211) of the inner piece (11, 21).

The converging channels are used to form the spray. These channels start from the peripheral edge of the front wall (122, 222) of the cavity of the outer piece or of the front face (111, 211) of the inner piece, and open tangentially, or at least non-radially, into a circular cavity, so that when the two pieces are assembled, a turbulence chamber (127, 227, 227') is formed, which facilitates formation of the spray. This process is known as "mechanical break-up". A cylindrical stud (113, 213') can be located in the center of the circular space forming the turbulence chamber (127, 227') to promote turbulence of the flow.

To form a good spray, it is important that the outlet opening through which the spray formed in the turbulence chamber exits be as small as possible. This opening is generally frustoconical. However, current injection techniques do not make it possible to obtain reliably outlet orifices having diameters of less than 0.2 mm. To overcome this difficulty, the invention envisions to form an outlet opening having a diameter that can be relatively large, and to place, on the front face (111) of the inner piece, a protrusion (113, 114) whose free end opposite the front face, which end is called torpedo (114), is intended to penetrate, at least partially, into the outlet opening, and whose dimensions are slightly smaller than those of the outlet opening (123). A thin annular outlet opening is thus formed, which is clearly visible in FIG. 8. A function of the torpedo is therefore to reduce the transverse cross-section of the outlet opening. In the example of FIG. 2 and FIG. 25, the torpedo (114) is placed above the cylindrical stud (113) located in the center of the turbulence chamber (127). In practice, the opening is in the form of a channel that starts from the turbulence chamber (127) and opens on the outer face of the front wall (122) of the cavity of the outer piece. The outlet opening (123) can be divided into a cylindrical lower portion (123*a*) and a frustoconical upper portion (123*b*), and the torpedo can be divided into a frustoconical lower portion (114*a*) and a cylindrical upper portion (114*b*). In the assembled state, the torpedo (114) penetrates into the outlet opening (123). It is dimensioned so that its front portion (114*c*), that is to say, the free end of the upper cylindrical portion (114*b*) located opposite the stud (113) of the turbulence chamber, is flush with the outer face of the front wall (122) of the outer piece. The combination of the frustoconical shape of the upper end of the opening (123) and the cylindrical shape of the end of the torpedo contributes to accelerate the flow of the spray by reducing more and more the transverse cross-section of the annular space as it approaches the outer face of the front wall (112). In the assembled state of the nozzle, and as seen from the axis of symmetry (A) in the direction of flow of the liquid and the spray, the outlet opening (123) begins downstream of the converging channels, and the converging channels end upstream of the torpedo. The torpedo can therefore penetrate into the narrowest part of the outlet opening.

It is possible to place such a torpedo (214') on the inner piece of a variant (2') of the 2nd nozzle (see FIG. 26 to FIG. 28). As in the case of the first nozzle, the torpedo (214') is preceded in the central turbulence chamber (227') by a turbulence stud (213'). In the case of the second nozzle, the outlet opening (223, 223') is always located downstream of the central turbulence chamber (227, 227') and, when placing oneself on the axis of symmetry (A), behind the turbulence chamber in the direction of the product flow, but it does not necessarily start closer to the outer face of the front wall (222) than certain portions of the converging channels. In other words, the lower portion of the outlet opening can be surrounded by at least a portion of the converging channels, although these converging channels do not open into this outlet opening. This is clearly visible, for example, on the cross-section of FIG. 23.

As an example, the diameter of the opening at the narrowest point can be 0.45 mm and that of the torpedo at this narrowest diameter can be 0.40 mm, thus forming a slit of 0.025 mm between the two pieces. One can also place a torpedo in an orifice that in itself would have been enough for a spray of acceptable quality. The presence of the torpedo then improves this quality. For example, a 0.1 mm diameter torpedo can be placed in a 0.2 mm hole (measured at the narrowest point of the outlet opening).

The lateral channels (112, 224) can be vertical, as in the exemplary embodiments presented in FIG. 1 and FIG. 13. In other words, the channels extend parallel to an axial plane defined by the axis of symmetry (A). They define the shortest path between the nozzle inlet and the converging channels. It is also possible to make them according to a geometry that deviates from the vertical. For example, they can have an helical shape as in FIG. 25, or even a zigzag shape. In this case, the lateral channels (112') do not extend parallel to an axial plane defined by the axis of symmetry (A), but diverge from this axial plane. This allows the channels to be lengthened while keeping the same height for the nozzle. In general, the shorter the channel, the greater the flow. By shifting the lateral channels away from the vertical, their length is increased, which makes it possible to adapt the flow rate to specific needs while retaining the same size for the nozzle. Moreover, it is possible to tilt the flow of product, at least at the junction with the converging channels, which allows the flow to penetrate into these converging channels in an optimal manner.

In the example of the 1st nozzle, the lateral channels are placed on the inner piece (11). The transverse cross-section of these lateral channels decreases slightly between the inlet located at the bottom face and the outlet located at the front face (111). In addition, the side walls of the lateral channels (112) are not radial, but slightly inclined in the same direction relative to the radial direction. This is clearly visible in FIG. 3 showing the inner piece seen from below.

Regarding the lateral channels (224) of the 2nd nozzle, they are placed on the inner face of the tubular wall (221) of the outer piece. They also have a transverse cross-section that decreases due to a slight inclination of the side walls and of the bottom wall of the channels. One of the side walls of the lateral channels is rounded and is located in the extension of the side wall of the converging channels. This rounded shape of the side wall helps guide the flow into the corresponding converging channel. The second side wall of the lateral channels is straight and substantially radial.

The converging channels can be placed in the front wall of the cavity of the outer piece or on the front face of the inner piece.

In the example of the 2nd nozzle, there are two sets of converging channels. The converging channels of the first set start from the lateral channels and open radially into a first annular cavity, from which the channels of the second set start, and these channels of the second set open radially into a second circular or annular cavity that forms the turbulence chamber (227, 227'), and from which the outlet opening (223) starts.

When the lateral channels and the converging channels are not made in the same piece, preferably, the inner piece (11) is oriented properly relative to the outer piece (12) and retains this orientation during the entire use of the dispenser carrying the nozzle, so as to ensure proper operation of the nozzle and to make it possible to limit the transverse cross-section of the lateral channels (112) at their junction with converging channels. For this purpose, it is possible to provide first orientation means, such as foolproof devices or orientation marks. Another solution is to orient the inner piece correctly before introducing it into the outer piece. Further, to maintain the proper orientation of the inner piece in the outer piece during the entire life of the dispenser, the inner piece (11) can be slightly oversized relative to the cavity of the outer piece (12), so that it is introduced by force and kept in the correct position by a tight fit. Thanks to this good orientation of the two parts, it is possible to limit the transverse cross-section of the lateral channels (112), since it is certain that they will open exactly into the inlet of the converging channels (125). It is self-evident that in the second nozzle also, the inner piece (21) can be blocked in the cavity of the outer piece (22), either by orientation means or by tight fitting or force fitting, although the question of the alignment of the lateral channels and the converging channels does not arise.

When the lateral channels and the converging channels are placed on the same piece, on the outer piece (22) in the case of the second nozzle, the question of orientation does not arise. It is then possible to provide that the inner piece (21) is held in the cavity of the outer piece (22) while being mobile in rotation about the main axis (A). In this case, it is possible to provide retaining means, for example a latching system, which prevents the inner piece from coming out of the cavity without preventing it from rotating. This solution can promote vibration of the nozzle and create a resonance phenomenon in the flow, which further improves the quality of the spray.

In an alternative embodiment of the invention, the nozzle is used in a dispenser for two-way valve. In this case, the conduit of the dispenser is designed to maintain the separation of the paths between the outlet of the stem of the valve and the nozzle. The first path of the valve is brought in contact with a portion of the lateral channels and the second path with the rest of the lateral channels. In this case, mixing of the products takes place in the turbulence chamber. The nozzle must therefore be oriented correctly in the dispenser. This can be done, either by keeping the initial orientation of the nozzle, for example, by keeping it in its molding cavity until the moment of its installation in the dispenser, or by providing orientation means such as foolproof devices. Another solution consists in distributing the inlets of the lateral channels and/or their angular extent so that, whatever the position of the nozzle, the same lateral channel cannot be in contact simultaneously with the first path and with the second path.

In addition, it is possible to provide, on the rear face (115, 215) of the inner piece (11, 21), which face is opposite the front face (111, 211), one or more divergent channels, which are identical to or different from the converging channels. Exemplary divergent channels 128 on the rear face of a variant of the inner piece are illustrated schematically on FIG. 30.

The outer piece (12, 22) is preferably made of polyacetal such as POM. It can also be made of polyamide or semi-crystalline polyester such as PBT. The inner piece (11, 21) is preferably made of polyacetal such as POM. It can also be made of polyamide or semi-crystalline polyester such as PBT. These materials have the advantage that they are fluid and allow molding of precision parts with good geometric and dimensional stability. In addition, they are rigid, which makes it possible to provide proper anchoring of the nozzle in the dispenser via the anchoring means (126, 226), which grip onto the softer PP-type material of the dispenser. In addition, in the event that sterilization by ionizing radiation is required for the dispenser equipped with its nozzle, the PBT will behave better than POM or certain PAs.

The nozzle of the invention is placed in a housing provided directly at the outlet of the conduit. Anchoring means (126, 226) ensure secure attachment of the nozzle at the outlet of the conduit of the dispenser. The nozzle retained in this manner cannot be ejected, even when the pressure prevailing inside the conduit is high and the valve is open. If necessary, the bottom of the housing can have divergent channels that open into the lateral channels of the nozzle. Exemplary divergent channels 129 on the bottom of a variant of the housing are illustrated schematically on FIG. 31.

The examples presented here are not limiting. In particular, the following variants can be envisioned, depending on needs:

- The cavity of the outer piece (12, 22) and the inner piece (11, 21) can have the shape of a cylinder or of a cone, not of revolution, but with a polygonal base. In particular, a polygonal base having the same number of sides as there are lateral channels can be provided.
- The front wall (12, 22) of the outer piece and the front face (111, 211) of the inner piece are substantially radial in the examples presented here. They could be given another shape, for example, conical or domed, for example, hemispherical.
- The number of lateral channels and converging channels is generally two or four. Other configurations can however be envisaged.

It is self-evident that the following characteristics can be used independently of one another and that it would be possible to provide nozzles having one or more of these characteristics:

- outlet opening associated with a torpedo;
- lateral channels that are non-vertical, i.e., that diverge from the axial plane, for example, helical channels;
- inner piece free in rotation in the outer piece.

By choosing a two-piece structure, it is possible to give any kind of shape to the channels, in particular to the lateral channels, and to adjust their lengths, for a same given size of the inner piece.

It is self-evident that the torpedo can also be used in an opening whose dimensions would have been sufficient to produce a quality spray. In this case, the presence of the torpedo contributes to further reduce the section of the opening, so as to further increase the quality of the spray.

List of references

| | | | |
|---|---|---|---|
| 1 | 1st nozzle | 2 | 2nd nozzle |
| 11 | Inner piece | 21 | Inner piece |
| 111 | Front face | 211 | Front face |
| 112 | Lateral channels | | |
| 113 | Turbulence stud | 213 | Turbulence stud |
| 114 | Torpedo | 214 | Torpedo |
| 114a | Frustoconical lower portion | | |
| 114b | Cylindrical upper portion | | |
| 114c | Free end | | |
| 115 | Rear face | 215 | Rear face |
| 12 | Outer piece | 22 | Outer piece |
| 121 | Tubular wall | 221 | Tubular wall |
| 122 | Front wall | 222 | Front wall |
| 123 | Outlet opening | 223 | Outlet opening |
| | | 224 | Lateral channels |
| 125 | Converging channels | 22 | Converging channels |
| 126 | Anchoring means | 226 | Anchoring means |
| 127 | Turbulence chamber | 227 | Turbulence chamber |
| 128 | Divergent channels | | |
| 129 | Divergent channels | | |
| 3 | Aerosol dispenser provided with a nozzle according to the invention | | |

The invention claimed is:

1. Two-piece nozzle for aerosol dispenser, comprising an outer piece provided with a tubular wall open on one side and closed on the other by a front wall, forming a cavity, the front wall being provided in a center thereof with an outlet opening, the outer piece having a certain symmetry about an axis of symmetry, an inner piece separate from the dispenser for which the nozzle is intended, the inner piece being dimensioned to penetrate into the cavity of the outer piece and be retained there, the inner piece having a front face facing the front wall of the outer piece, channels provided in the cavity of the outer piece and/or on a surface of the inner piece, wherein the channels open into a turbulence chamber in communication with the outlet opening, the outlet opening being placed in the flow path of the product flow downstream of the turbulence chamber, wherein each of the cavity of the outer piece and the inner piece has a shape of a cylinder of revolution or of at least a portion of a cone of revolution about the axis of symmetry, and wherein the channels are divided into (i) separate lateral channels made in an envelope of the cylindrical or frustoconical shape of at least one selected from the group consisting of the inner piece and the cavity of the outer piece, and (ii) converging channels made in the front wall of the outer piece or in the front face of the inner piece, wherein the respective lateral channels are entirely separate from one another between respective inlets and respective outlets thereof, and a transverse cross-section of each of the respective lateral channels decreases in a direction from a respective inlet to a respective outlet thereof located at the front face of the inner piece or the front wall of the outer piece.

2. Nozzle according to claim 1, wherein the lateral channels are substantially parallel to an axial plane defined by the axis of symmetry.

3. Nozzle according to claim 1, wherein the lateral channels diverge from the axial plane defined by the axis of symmetry.

4. Nozzle according to claim 3, wherein the lateral channels have a helical shape.

5. Nozzle according to claim 1, wherein the converging channels extend from the cylindrical or frustoconical envelope of the inner piece or of the cavity of the outer piece toward the turbulence chamber.

6. Nozzle according to claim 5, wherein the converging channels emerge tangentially into the turbulence chamber.

7. Nozzle according to claim 1, wherein the inner piece is dimensioned to be retained by a tight fit in the cavity of the outer piece so as to be immobilized there.

8. Nozzle according to claim 1, wherein at least one selected from the group consisting of the inner piece and/or the outer piece are provided with first orientation means for orienting the inner piece relative to the outer piece to align the channels with one another, the nozzle is provided with second orientation means for orienting the nozzle relative to the dispenser for which it is intended.

9. Nozzle according to claim 1, wherein the inner piece has a rear face provided with divergent channels.

10. Nozzle according to claim 1, wherein the nozzle is mounted in a housing of an aerosol dispenser.

11. Aerosol dispenser comprising a nozzle according to claim 1, wherein the nozzle is mounted in a housing of the aerosol dispenser, wherein the housing has a bottom face provided with divergent channels.

12. Nozzle according to claim 1, wherein each of the respective lateral channels comprises a bottom wall and two lateral walls, the bottom wall and the lateral walls being inclined so that the transverse cross-section of the respective lateral channel decreases in the direction from the respective inlet to the respective outlet thereof located at the front face of the inner piece or the front wall of the outer piece.

13. Nozzle according to claim 1, wherein each of the respective lateral channels comprises a bottom wall and two lateral walls, one of the lateral walls being rounded and located in the extension of the bottom wall.

14. Nozzle according to claim 13, wherein the other of the lateral walls is straight and substantially radial.

15. Nozzle according to claim 1, wherein each of the lateral channels comprises a bottom wall and two lateral walls, the lateral walls being inclined relative to a radial direction, the two lateral walls being inclined in a same non-radial direction relative to the radial direction.

16. Nozzle according to claim 1, wherein a protrusion is placed in a center of the front face of the inner piece, the protrusion being dimensioned so that a free portion of the protrusion opposite the front face, which portion is called torpedo, penetrates into the outlet opening to reduce the cross section of the outlet opening and form an annular outlet orifice.

17. Nozzle according to claim 16, wherein the torpedo is dimensioned to pass through the outlet opening over an entire height thereof so that a front face of the torpedo is flush with an outer face of the front wall of the outer piece in an assembled state of the nozzle.

18. Nozzle according to claim 16, wherein a transverse cross-section of the annular outlet orifice is less than 0.0315 $mm^2$.

19. Nozzle according to claim 16, wherein a portion of the outlet opening located near an outer face of the front wall has a frustoconical shape, and wherein an end of the torpedo located opposite the front face has a cylindrical shape so that a transverse cross-section of an annular space between the outlet opening and the torpedo decreases in a direction from an inner side of the outlet opening toward the outer face of the front wall.

* * * * *